US008915703B2

(12) United States Patent
Mohammed

(10) Patent No.: US 8,915,703 B2
(45) Date of Patent: Dec. 23, 2014

(54) INTERNALLY ACTUATED INLET GUIDE VANE FOR FAN SECTION

(75) Inventor: Sohail Mohammed, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 638 days.

(21) Appl. No.: 13/192,517

(22) Filed: Jul. 28, 2011

(65) Prior Publication Data

US 2013/0028715 A1 Jan. 31, 2013

(51) Int. Cl.
*F04D 29/56* (2006.01)
*F01D 17/16* (2006.01)

(52) U.S. Cl.
CPC ..... *F04D 29/563* (2013.01); *F01D 17/162* (2013.01)
USPC ..... 415/160

(58) Field of Classification Search
CPC ..... F01D 17/14; F01D 17/16; F01D 17/162; F02C 9/20; F02C 9/22; F04D 29/563
USPC ..... 415/148, 150, 155, 159, 160, 161, 162, 415/163, 164, 165, 166
See application file for complete search history.

(56) References Cited

U.S. PATENT DOCUMENTS 1,896,808 A * 2/1933 Bentley ..... 415/38
2,455,251 A * 11/1948 Hersey ..... 415/14
2,805,818 A * 9/1957 Ferri ..... 415/148
2,955,744 A * 10/1960 Hemsworth ..... 415/160
3,113,430 A * 12/1963 Beale et al. ..... 60/796
3,237,918 A * 3/1966 Le Bell et al. ..... 415/210.1
3,295,827 A * 1/1967 Chapman et al. ..... 416/159
3,334,521 A * 8/1967 Kast ..... 74/110
3,397,836 A * 8/1968 Badger et al. ..... 415/156
3,458,118 A * 7/1969 Follmer et al. ..... 415/149.4
3,632,224 A * 1/1972 Wright et al. ..... 415/149.4
3,779,665 A * 12/1973 Tatem et al. ..... 415/123
3,861,822 A * 1/1975 Wanger ..... 415/147
4,009,571 A * 3/1977 Black et al. ..... 60/354
4,275,560 A * 6/1981 Wright et al. ..... 60/226.3
4,400,135 A * 8/1983 Thebert ..... 415/134
4,546,606 A * 10/1985 Bouiller et al. ..... 60/262
4,867,636 A * 9/1989 Sauron et al. ..... 415/160
4,978,280 A * 12/1990 Tubbs ..... 415/159

(Continued)

FOREIGN PATENT DOCUMENTS

DE 764219 5/1953
EP 765992 A1 4/1997
FR 2599086 11/1987
GB 2471843 A 9/2011

OTHER PUBLICATIONS

European search report for European Application No. 12177693.4-2321 completed Nov. 27, 2012.

*Primary Examiner* — Edward Look
*Assistant Examiner* — Eldon Brockman
(74) *Attorney, Agent, or Firm* — Carlson, Gaskey & Olds, PC

(57) ABSTRACT

A variable inlet guide vane assembly includes a plurality of circumferentially spaced inlet guide vanes mounted to pivot to change an angle of the guide vanes relative to an air flow. An actuator actuates the plurality of inlet guide vanes to change the angle, and is positioned radially inward of the inlet guide vanes.

19 Claims, 3 Drawing Sheets

(56) References Cited

U.S. PATENT DOCUMENTS

| | | | | |
|---|---|---|---|---|
| 5,931,636 | A * | 8/1999 | Savage et al. | 415/115 |
| 5,993,152 | A * | 11/1999 | Schilling | 415/160 |
| 6,106,227 | A * | 8/2000 | Honda et al. | 415/145 |
| 7,011,494 | B2 * | 3/2006 | Kies et al. | 415/148 |
| 7,198,461 | B2 * | 4/2007 | Burgmeier et al. | 415/160 |
| 7,588,415 | B2 * | 9/2009 | Giaimo et al. | 415/160 |
| 7,628,579 | B2 * | 12/2009 | Giaimo et al. | 415/160 |
| 7,632,064 | B2 | 12/2009 | Somanath et al. | |
| 7,665,959 | B2 * | 2/2010 | Giaimo et al. | 415/160 |
| 7,690,889 | B2 * | 4/2010 | Giaimo et al. | 415/160 |
| 7,753,647 | B2 * | 7/2010 | Giaimo et al. | 415/160 |
| 7,802,963 | B2 * | 9/2010 | Holland et al. | 415/148 |
| 7,901,178 | B2 * | 3/2011 | Giaimo et al. | 415/160 |
| 8,297,918 | B2 * | 10/2012 | Bhatnagar | 415/160 |
| 8,454,304 | B2 * | 6/2013 | Agiriano et al. | 415/142 |
| 2005/0135926 | A1 * | 6/2005 | Selby | 415/160 |
| 2006/0245676 | A1 * | 11/2006 | Bruce et al. | 384/192 |
| 2007/0237631 | A1 * | 10/2007 | Lytle | 415/191 |
| 2008/0317587 | A1 * | 12/2008 | Lord et al. | 415/160 |
| 2009/0074569 | A1 * | 3/2009 | Garcin et al. | 415/148 |
| 2010/0158662 | A1 * | 6/2010 | Colotte et al. | 415/33 |
| 2011/0176913 | A1 * | 7/2011 | Wassynger et al. | 415/159 |
| 2011/0211941 | A1 * | 9/2011 | Hirokawa et al. | 415/148 |
| 2011/0229310 | A1 * | 9/2011 | Colotte et al. | 415/149.4 |
| 2012/0087780 | A1 * | 4/2012 | Suciu et al. | 415/159 |
| 2012/0257963 | A1 * | 10/2012 | Major et al. | 415/182.1 |
| 2012/0263571 | A1 * | 10/2012 | Ress, Jr. | 415/1 |

* cited by examiner

INTERNALLY ACTUATED INLET GUIDE VANE FOR FAN SECTION

BACKGROUND

This application relates to a set of inlet guide vanes which are provided with an actuator to vary the position of the vanes, and wherein the actuator is positioned radially inwardly of the vanes.

Gas turbine engines are known, and typically have a fan delivering air into a compressor section. The compressor compresses air and delivers it into a combustion section. The air is mixed with fuel and combusted in the combustion section, and products of that combustion pass downstream over turbine rotors.

Typically, the fan includes a rotor driving a plurality of rotor blades. Inlet guide vanes direct and control the air flow approaching the rotor blades. One known type of inlet guide vanes has a variable angle which is changed by an actuator. By changing the position of the inlet guide vanes, the direction the air approaches the rotor, as well as the volume of air approaching the rotor can be controlled. A single actuator actuates or changes the position of a plurality of circumferentially spaced inlet guide vanes. The actuators have typically been positioned at a radially outer portion of the gas turbine engine.

In addition, the actuators have typically rotated a ring to change the position of the inlet guide vanes.

SUMMARY

A variable inlet guide vane assembly includes a plurality of circumferentially spaced inlet guide vanes mounted to pivot to change an angle of the guide vanes relative to an air flow. An actuator actuates the plurality of inlet guide vanes to change the angle, and is positioned radially inward of the inlet guide vanes.

A gas turbine engine is also disclosed.

These and other features of the present invention can be best understood from the following specification and drawings, of which the following is a brief description.

DETAILED DESCRIPTION

Figure 1:
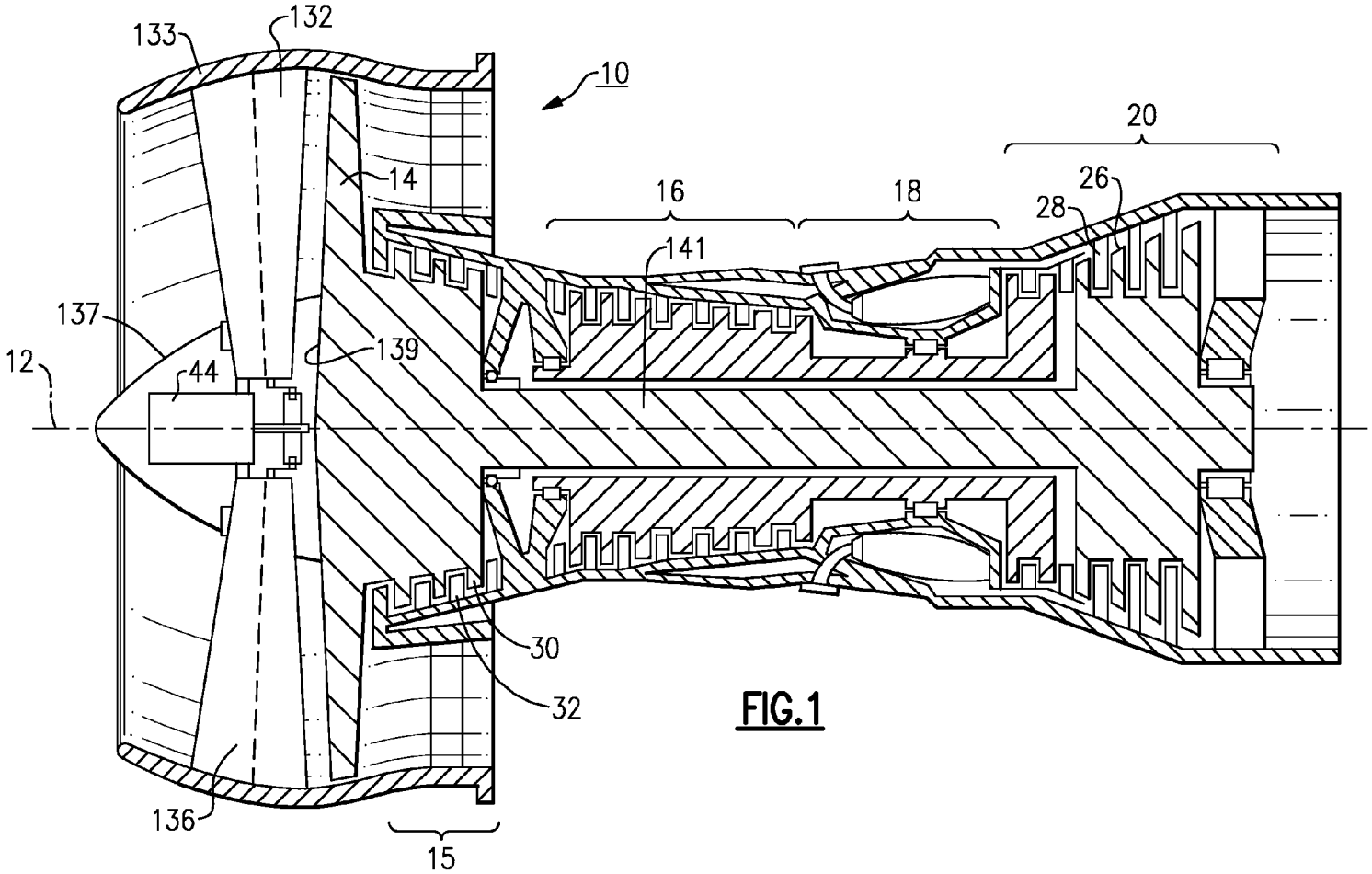
FIG. 1 schematically shows a gas turbine engine.

A gas turbine engine 10, such as a turbofan gas turbine engine, circumferentially disposed about an engine centerline, or axial centerline axis 12 is shown in FIG. 1. The engine 10 includes a fan section 14, compressor sections 15 and 16, a combustion section 18 and a turbine section 20. As is well known in the art, air compressed in the compressor 15/16 is mixed with fuel and burned in the combustion section 18 and expanded in turbine 20. The compressor section 15 is a "low pressure" compressor, which feeds compressed air into the "high pressure" compressor 16. The turbine 20 comprises alternating rows of rotary airfoils or blades 26 and static airfoils or vanes 28. Similarly, the compressor sections 15/16 include rotor blades 30 and vanes 32. In fact, this view is quite schematic. It should be understood that this view is included simply to provide a basic understanding of the sections in a gas turbine engine, and not to limit the invention. This invention extends to all types of turbine engines for all types of applications.

Features which are unique in this application are shown within the fan section of FIG. 1. As shown, an inlet frame 136 extends inwardly from a cowl 133. A cone 137 is positioned forwardly of the inlet frame 136, and fixed to it. An actuator 44 for actuating variable guide vanes 132 which are attached to the inlet frame 136 is also shown. As shown, the actuator 44 is positioned outwardly of a forward most end 139 of a shaft 141 which drives several rotors included in the gas turbine engine 10.

Figure 2:
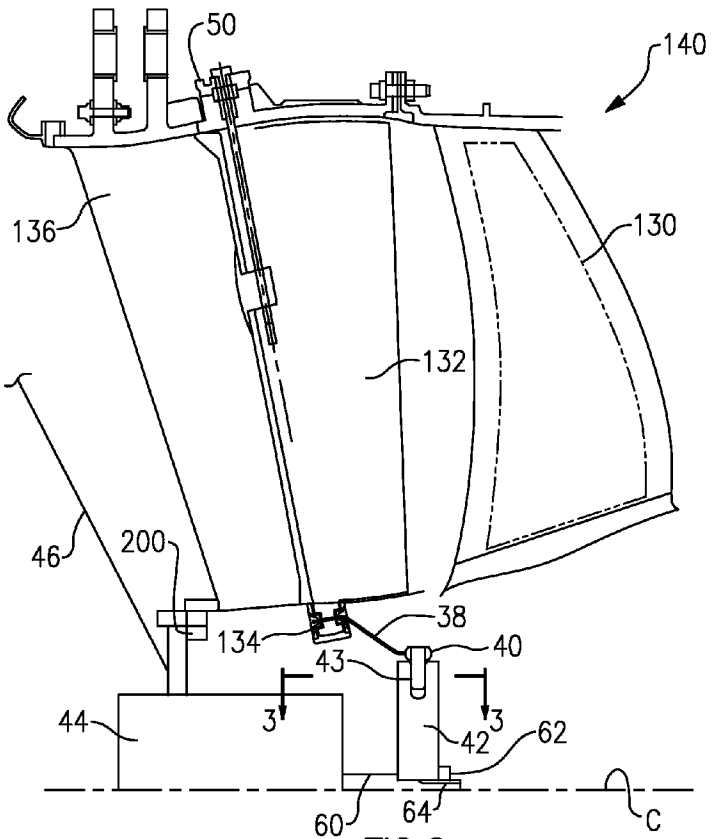
FIG. 2 shows a portion of an inlet guide vane.

FIG. 2 shows a portion of the fan section 14. As known, a rotor carries rotor blades 130 which rotate with the rotor.

The rotor blades 130 are positioned to be adjacent inlet guide vanes 132. The inlet guide vanes 132 are variable angle vanes, and are pivotally mounted such as shown at 50 and at 134. The inlet guide vanes 132 may be positioned adjacent to fixed inlet frame 136. The inlet frame is shown somewhat simplistically, and typically includes inner and outer cylindrical rings connected by a plurality of struts. The connection 200 of the actuator 44 to the inlet frame 136 is shown somewhat schematically, but may be at the cylindrical portion at the inner periphery. As can be appreciated from FIG. 1, the shaft which drives the rotor blades 130 would be positioned to the right of the forward most movement of the cam ring 42.

An actuator 44 is mounted radially inwardly of the guide vanes 132 and fixed to inlet frame 136 at 200. The inlet frame actuator 44 drives a rod 60 on a line C. The rod 60 has a threaded rod end 64, and a nut 62 secures a cam ring 42. The actuator 44 may be a hydraulic or electric actuator. As shown, a fluid or electric current supply 46 provides power or hydraulic fluid to the actuator 44.

The cam ring 42 has a cam slot 43. A cam roller 40 is positioned in the slot 43

Figure 3:
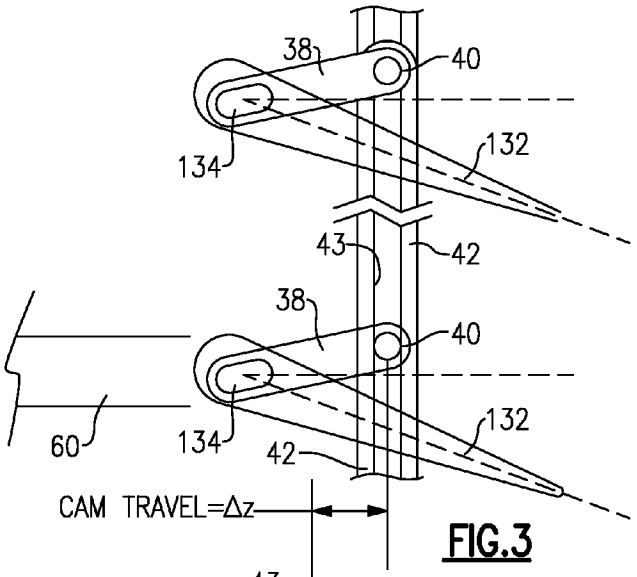
FIG. 3 shows an inlet guide vane in an open position.

A link 38 connects the roller 40 to the pivot point 134 on the inlet guide vane 132. A spherical bearing maybe used between a link 38 and a roller 40 to prevent constraints to either the link or the roller during actuation As shown in FIG. 3, if the cam ring 42 is extended, the link 38 is moved axially, and causes the vane 132 to pivot to a vane open position. Plural links 38 and vanes 132 are associated with the cam ring 42. As can be seen in FIG. 3 there are a plurality of rollers 40 mounted within a common cam slot 43.

Figure 4:
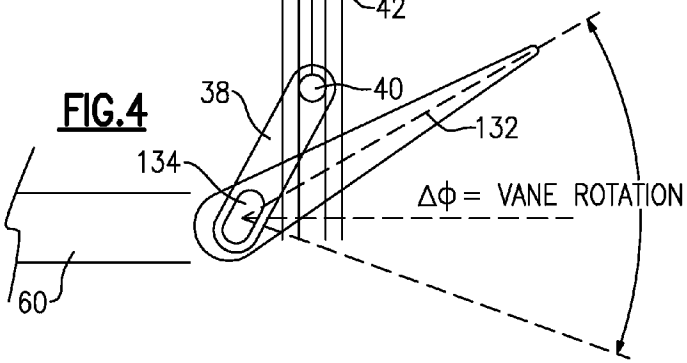
FIG. 4 shows the inlet guide vane in a closed position.

Alternatively, as shown in FIG. 4, when cam ring 42 is retracted, the link 38 pivots the vane 132 to a relatively closed position.

Figure 5:
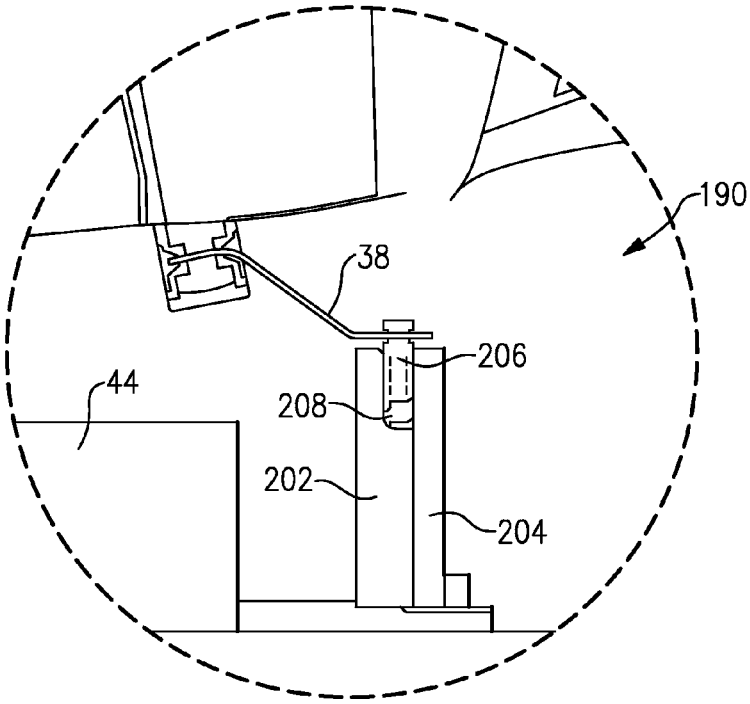
FIG. 5 shows a second embodiment.

Another embodiment 190 is illustrated in FIG. 5. In embodiment 190, the operation is generally the same as in the original embodiment. However, additional features have been introduced to prevent roller binding during cam actuation. Here the single cam is constructed in two pieces 202 and 204 to enable assembly of a roller cage 208 receiving the rollers 206. Axial translation of the cam 202 and 204 is intended to translate the roller cage 208 and the rollers 206 in the axial direction. Simultaneous movement of the rollers 206 in the circumferential direction, forced by the links 38, will also rotate the cage 208 about the engine centerline 12, ensuring the centerlines of the rollers always intersect engine centerline preventing any potential binding of rollers 206 in the cam slot 43.

Figure 6:
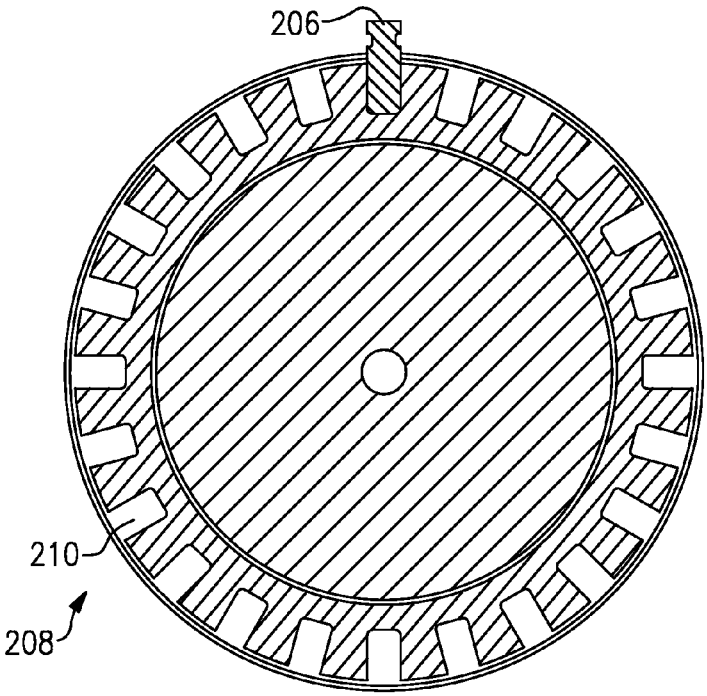
FIG. 6 shows another feature of the second embodiment.

The roller cage 208 is illustrated in FIG. 6 having plurality of slots 210 to receive the rollers 206. The roller cage 208 is preferred to have fine surface finishes where it makes contact with the cam slot 43 and rollers 206 during actuation. Roller cage 208 constructed with self-lubricating material such as, WEARCOMP™ or FIBERCOMP™ may help improve actuation.

A worker of ordinary skill in the art would recognize when it would be desirable to position the vane in the different positions. However, the use of the actuator and linkage assembly positioned radially inward of the guide vane allows for a smaller profile engine than the prior art which provided the actuator radially outward of the vanes. Further, the use of the axially moving cam ring is simpler to operate than the prior art rotating cam rings.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A variable inlet guide vane assembly comprising:

a plurality of circumferentially spaced inlet guide vanes mounted to pivot and change an angle of the guide vanes relative to an air flow;

an actuator configured to actuate said plurality of inlet guide vanes to change the angle, said actuator being positioned radially inward of said inlet guide vanes;

said actuator driving a cam ring, said cam ring moving a link associated with each of said inlet guide vanes, to change the angle;

said actuator driving a piston rod, said piston rod being secured to said cam ring such that said cam ring moves with said piston rod; and there is no actuator radially outward of said inlet guide vanes to provide a smaller envelope.

2. The assembly as set forth in claim 1, wherein said cam ring has a slot which carries a roller associated with each of the links.

3. The assembly as set forth in claim 1, wherein said cam ring is moved axially and causes said links to move said inlet guide vanes to pivot, and thus change said angle.

4. The assembly as set forth in claim 2, wherein a roller cage is positioned to ride with the cam slot.

5. The assembly as set forth in claim 4, wherein said roller cage is formed of a material having self-lubricating properties.

6. The assembly as set forth in claim 1, wherein said actuator is one of a hydraulic or electric actuator.

7. The assembly as set forth in claim 1, wherein said actuator is to be positioned outwardly of an end of a shaft for driving a rotor associated with the variable inlet guide vane assembly.

8. The assembly as set forth in claim 1, wherein said inlet guide vane assembly is to be utilized as part of a gas turbine engine fan section.

9. A gas turbine engine comprising:

a turbine section;

a combustor section;

a compressor section; and a fan section including a plurality of rotor blades rotating with a rotor, and a plurality of circumferentially spaced inlet guide vanes positioned to be upstream of said rotor blades, said inlet guide vanes mounted to pivot to change an angle of the guide vanes relative to an air flow, an actuator for actuating said plurality of inlet guide vanes to change the angle, said actuator being positioned radially inward of said variable inlet guide vanes;

said actuator driving a cam ring, said cam ring moving a link associated with each of said inlet guide vanes, to change the angle;

said actuator driving a piston rod, said piston rod being secured to said cam ring such that said cam ring moves with said piston rod; and there is no actuator radially outward of said inlet guide vanes to provide a smaller envelope.

10. The gas turbine engine as set forth in claim 9, wherein said cam ring has a slot which carries a roller associated with each of the links.

11. The gas turbine engine as set forth in claim 9, wherein said cam ring is moved axially and causes said links to move said inlet guide vanes to pivot, and thus change said angle.

12. The gas turbine engine as set forth in claim 9, wherein said actuator is one of a hydraulic or electric actuator.

13. The assembly as set forth in claim 10, wherein a roller cage is positioned to ride with the cam slot.

14. The assembly as set forth in claim 13, wherein said roller cage is formed of a material having self-lubricating properties.

15. The assembly as set forth in claim 9, wherein said actuator is positioned outwardly of an end of a shaft for driving the rotor.

16. A variable inlet guide vane assembly comprising:

a plurality of circumferentially spaced inlet guide varies mounted to pivot and change an angle of the guide vanes relative to an air flow;

an actuator configured to actuate said plurality of inlet guide vanes to change the angle, said actuator being positioned radially inward of said inlet guide vanes;

said actuator driving a cam ring, said cam ring moving a link associated with each of said inlet guide vanes, to change the angle;

said actuator driving a piston rod, said piston rod being secured to said cam ring such that said cam ring moves with said piston rod;

said cam ring has a slot which carries a roller associated with each of the links, and a single slot carries a plurality of said rollers, with one said roller associated with each of the links.

17. The assembly as set forth in claim 16, wherein there is no actuator radially outward of said inlet guide vanes to provide a smaller envelope.

18. A gas turbine engine comprising:

a turbine section;

a combustor section:

a compressor section;

a fan section including a plurality of color blades rotating with a rotor, and a plurality of circumferentially spaced inlet guide vanes positioned to be upstream of said rotor blades, said inlet guide vanes mounted to pivot to change an angle of the guide vanes relative to an air flow, an actuator for actuating said plurality of inlet guide vanes to change the angle, said actuator being positioned radially inward of said variable inlet guide vanes;

said actuator driving a cam ring, said cam ring moving a link associated with each of said inlet guide vanes, to change the angle;

said actuator driving a piston rod, said piston rod being secured to said cam ring such that said cam ring moves with said piston rod;

said cam ring has a slot which carries a roller associated with each of the links; and a single slot carries a plurality of said rollers, with one said roller associated with each of the links.

19. The gas turbine engine as set forth in claim 18, wherein there is no actuator radially outward of said inlet guide vanes to provide a smaller envelope.

* * * * *